United States Patent [19]

Easton et al.

[11] 3,965,947

[45] June 29, 1976

[54] TANK FILLING SYSTEM EMPLOYING EMERGENCY SHUT-OFF VALVE

[75] Inventors: Richard L. Easton; Richard A. Buseth, both of Jackson, Mich.

[73] Assignee: Aeroquip Corporation, Jackson, Mich.

[22] Filed: Apr. 6, 1973

[21] Appl. No.: 348,590

[52] U.S. Cl. ..... 141/207; 137/390; 141/302

[51] Int. Cl.[2] ..... B65B 57/14

[58] Field of Search ..... 137/389, 390, 393; 141/13, 46, 128, 192, 198, 206, 207, 208, 210, 214, 215, 217, 218, 228, 346, 347, 367, 382, 291–296, 301, 302

[56] References Cited

UNITED STATES PATENTS

| | | | |
|---|---|---|---|
| 3,513,887 | 5/1970 | Limandri | 141/207 |
| 3,590,886 | 7/1971 | Judd | 141/198 |
| 3,625,264 | 12/1971 | Swain | 141/198 |
| 3,643,707 | 2/1972 | Ensign | 141/128 X |
| 3,774,656 | 11/1973 | Mayer | 141/128 |

*Primary Examiner*—Richard E. Aegerter
*Assistant Examiner*—Frederick R. Schmidt
*Attorney, Agent, or Firm*—Beaman & Beaman

[57] ABSTRACT

A liquid handling system for filling tanks, such as tank trucks, particularly suitable for handling volatile fluids, employing a fill conduit and an emergency shutoff valve located at the upper end of the fill conduit. The emergency valve employs an annular, normally open, valve element axially displaceable to a shutoff position upon the liquid level within the tank reaching a predetermined maximum depth. Valve element operation is regulated by a control piston subjected to subatmospheric pressures produced by liquid flow through the valve and upon the liquid level reaching a predetermined depth the control piston is actuated to cause the valve element to terminate fluid flow. The emergency shutoff valve may be employed in conjunction with a variable rate flow valve connected in series therewith to produce a versatile tank filling system.

7 Claims, 7 Drawing Figures

TANK FILLING SYSTEM EMPLOYING EMERGENCY SHUT-OFF VALVE

BACKGROUND OF THE INVENTION

The invention pertains to filling systems for liquid storage tanks wherein tank filling is automatically terminated at a predetermined level to prevent overfill.

Tank trucks used to transport gasoline, and other liquids, usually consist of a truck-mounted tank having an opening, or pot, located at the upper portion of the tank compartment through which the compartment is filled. The driver positions the tank pot below the filling pipe or hose, and the liquid is introduced into the tank through the tank pot. In the normal practice, the operator observes the level of the liquid within the tank during filling and manually operates a shutoff valve to terminate the filling, if filling is not under the control of a preset stop-meter.

In the filling of tank trucks used to transport volatile liquids, such as gasoline, the truck driver usually fills his own truck at a storage depot. Modern gasoline storage installations for filling tank trucks used to distribute gasoline to retail outlets now usually utilize stop-meters which are preset to terminate fluid flow after a predetermined amount of gasoline has been metered. However, it occasionally happens that the operator will set the stop-meter to deliver a greater amount of liquid into the tank than the tank is able to receive. Such occurrence arises if the operator is not aware of the actual capacity of the tank compartment being filled, or more often, results from the fact that the tank compartment is partially full prior to refilling, and the operator is not aware that the tank already contains a liquid.

Such occurrences produce tank overfill through the tank pot resulting in the wasting of an expensive liquid, contamination of the environment due to the spilled gasoline, and the creation of a serious fire hazard.

When filling tanks with highly volatile liquids such as gasoline several unique problems occur. For instance, excessive splashing usually occurs during the initial stages of the filling of an empty tank which accelerates vaporization of the gasoline producing considerable fumes which quickly fill the tank and pass therefrom through the tank pot contaminating the atmosphere and also creating a potentially explosive mixture. Additionally, while it is desirable to fill the tank as quickly as possible in the interest of time, high flow rates through the hose, valves and fill conduit generate static electricity creating the possibility of producing a spark within the tank or adjacent the filling apparatus, which could ignite the gasoline fumes.

In order to minimize vaporization and agitation, deflector bases are often located at the lower end of gasoline tanker fill pipes which deflect the fuel at the bottom of the tank in such a direction as to minimize splashing and agitation. To minimize the creation of static electricity due to high flow rates, valve systems are used which permit the gasoline to flow into the tank at a reduced rate during the initial stages of filling, and once the tank is partially filled, and adequate grounding exists between the fill conduit and the tank, a greater fill rate is permitted. Such regulation of flow rates is manually regulated in prior art devices and is thereby subject to human error.

SUMMARY OF THE INVENTION

It is an object of the invention to provide a tank-filling system utilizing an emergency high level shutoff valve for automatically terminating tank filling upon the liquid depth reaching a predetermined level.

Another object of the invention is to provide a liquid tank filling apparatus utilizing an automatic shutoff valve to prevent the tank from overflowing, and an automatically operated multiple flow rate valve connected in series with the shutoff valve, to permit tank filling at acceptable rates of liquid flow.

An additional object of the invention is to provide a high level emergency shutoff valve for use with tank fill pipes wherein the valve is capable of handling high liquid capacities with little restriction, is operated between open and closed positions in a positive manner, utilizes fluid flow to aid in valve closing, and includes means for controlling the rate of valve closing to eliminate "water hammer" effects and damage to pump and hose apparatus.

An additional object of the invention is to provide tankfilling apparatus employing an emergency level shutoff valve preventing tank overflow wherein the apparatus may be used with tanks of varying depth, yet the automatic operation of the shutoff valve occurs at the desired liquid level within the associated tank.

In the practice of the invention the valve body includes an annular flow passage and an annular valve element controls liquid flow therethrough. The valve element is axially shiftable between open and closed positions and shifts in the direction of liquid movement when closing. Retaining of the valve element in the open position is accomplished through a positive detent system and the detent is operated by an expansible chamber motor located within the valve body. The expansible chamber motor communicates with an aspirator orifice defined in the valve body tending to create a subatmospheric condition within the expansible motor during fluid flow. The expansible motor is vented to the atmosphere within the tank filled at the maximum permissible liquid level and, upon the liquid level reaching the vent, the evacuation of the expansible motor chamber, due to the influence of the aspirator orifice, is greater than the venting occurring due to liquid entering the chamber, and the resultant pressure differential with respect to atmospheric pressure displaces the expansible chamber motor piston releasing the detent and permitting the valve element to move toward a closed condition.

Movement of the valve element to the closed or shutoff position is damped by a dashpot construction incorporated into the valve body to prevent damage to the pumping apparatus and producing "water hammer" effects. Opening or "resetting" of the shutoff valve is accomplished through a reset lever mounted in the valve body and, preferably, operation of the reset lever is through a key-type handle so that reopening of the valve may only be accomplished by authorized personnel.

DESCRIPTION OF THE PREFERRED EMBODIMENTS

A tank filling and emergency shutoff valve system constructed in accord with the invention may be used with most liquids and, in particular, this type of valve system has special advantages when used with highly volatile liquids such as gasoline. Use of the shutoff valve in the gasoline distribution art is of special significance in view of the dangerous and volatile characteristics of gasoline, and the serious consequences of overflowing a gasoline storage or transport tank. Furthermore, in the gasoline distribution trade it is common practice for tank truck drivers to fill their own trucks at the storage and distribution depots and, as the skill and experience of individual drivers significantly varies, the automatic operation of the valve, the apparatus for sensing potential overflow, and valve resetting, are such as to prevent usage of the filling equipment without employing the safety features thereof.

Figure 1:
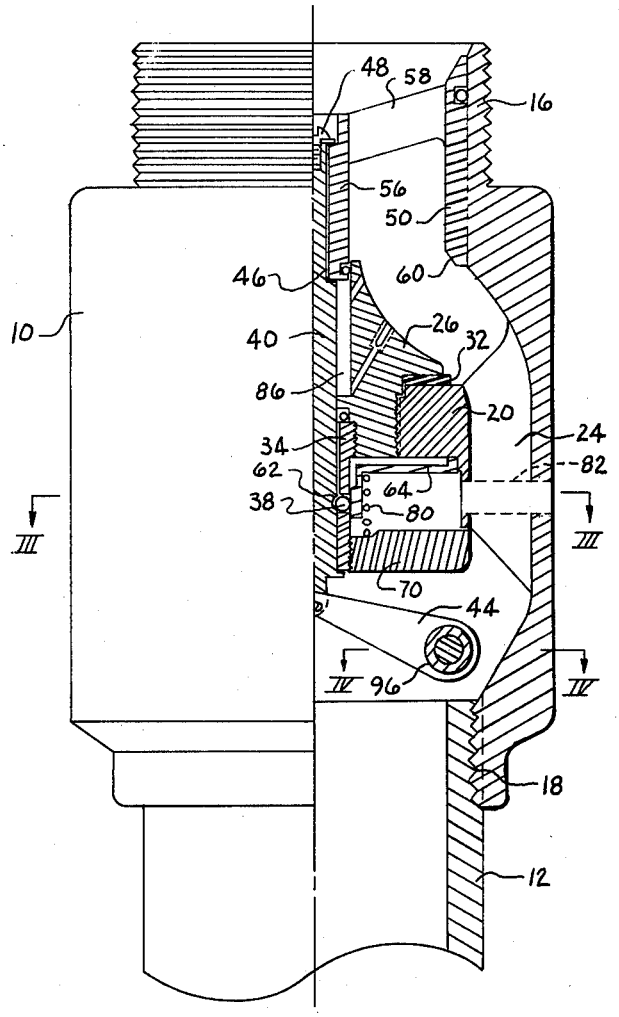
FIG. 1 is an elevational partially sectional view of a high level emergency shutoff valve constructed in accord with the invention as taken along I—I of FIG. 3 illustrating the valve element in the open position.
Figure 7:
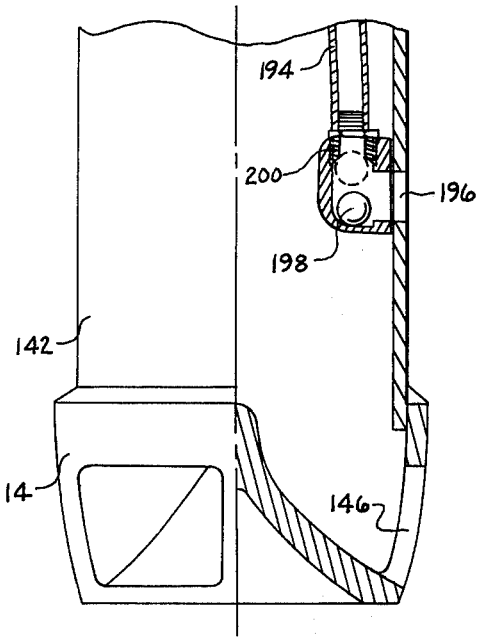
FIG. 7 is a partially sectional view of the lower part of the fill pipe illustrating the fast-slow valve sensing port.

In normal use, the valve body 10 is mounted upon the upper end of a fill pipe or conduit 12 which extends down into the tank to be filled. The lower end of the fill pipe constitutes the outlet for the filling apparatus and may include a deflector 14 such as shown in FIG. 7. In FIG. 1 the valve body is of a cylindrical configuration having a threaded inlet neck 16 which is connected to a hose or other liquid supply conduit, not shown, and the lower end of the valve body is threaded at 18 for connection to the fill pipe.

The interior of the valve body 10 includes a spider 20 centrally located within the valve body by three evenly spaced webs 22. Intermediate the spider and the housing an annular flow passage 24 of large volume is defined wherein fluid may flow downwardly through the valve body.

The shutoff valve element, and associated operating structure, is mounted upon the spider 20 and includes an annular sleeve 26 threadedly cooperating with the spider 20. The sleeve 26 includes a shoulder 28 overlying the spider surface 30 wherein the sleeve is used to position an annular sealing ring 32 upon the spider. The sealing ring 32 is preferably formed of a resilient material such as rubber, neoprene or suitable synthetic material which is not adversely affected by the liquid being handled.

A detent supporting ring 34 is threadedly mounted upon the sleeve 26, and includes three radially extending openings 36, each of which receives a locking detent ball 38. The openings and balls are located at 120° intervals about the circumference of the ring 34 in order to equalize the detent holding forces on the associated valve element structure.

The valve element support rod 40 is received within the ring 34 and the sleeve 26 is axially displaceable thereto, and a seal is produced by an O-ring. The rod 40, at its lower end, is provided with a slot and pin 42 for cooperating with the reset lever 44 as will be described, and the upper end of the rod is formed with a shoulder 46 and a threaded bore for receiving retaining screw 48.

Figure 2:
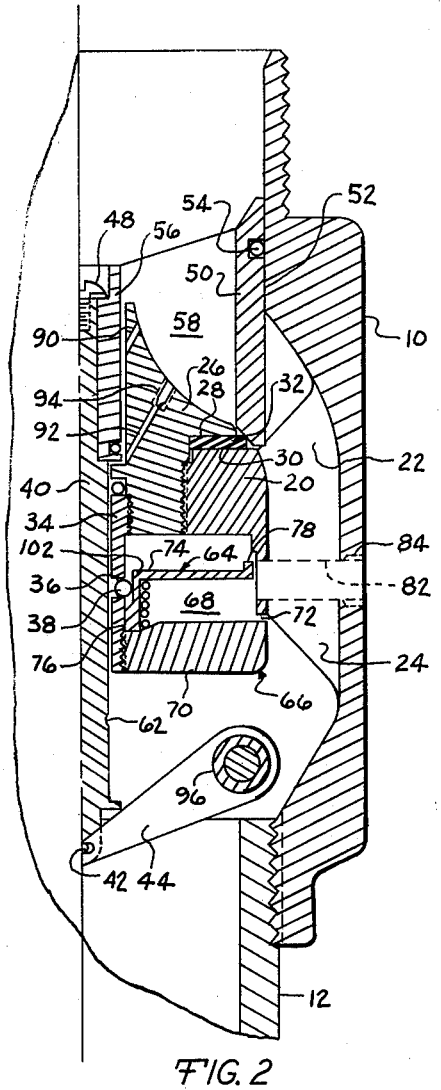
FIG. 2 is a detail elevational section view of the valve illustrating the valve element in the closed or shutoff position.
Figure 3:
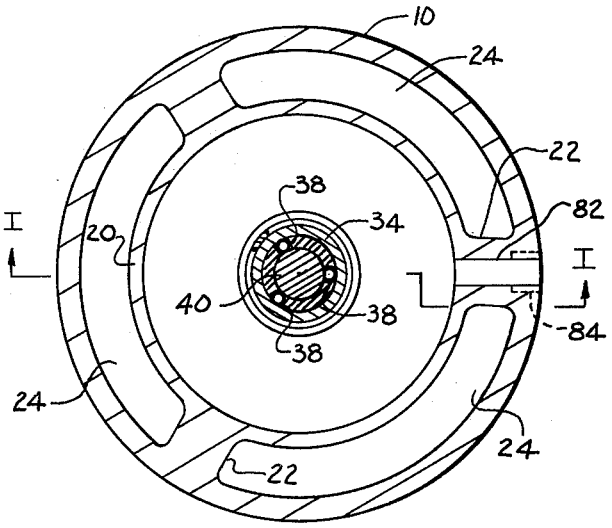
FIG. 3 is a plan sectional view taken through the detent and expansible motor along Section III—III of FIG. 1.
Figure 4:
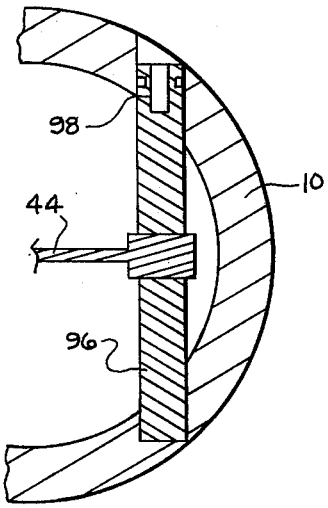
FIG. 4 is a detail sectional view taken through the reset lever along Section IV—IV of FIG. 1.

The shutoff valve element 50 is of an annular configuration slidably, sealingly cooperating with the valve body cylindrical surface 52 by O-ring seal 54. The valve element is connected to a webbed hub 56 mounted on the rod 40 between the annular shoulder 46 and the screw 48, and webs 58 interposed between the hub and valve element 50 permit a high volume of fluid to flow through the webs. The lower end of the valve element is beveled at 60 for sealingly cooperating with the seal ring 32, FIG. 2.

Axial positioning of the valve element 50 and rod 40 is determined by the cooperation of the detent balls 38 with an annular groove 62 defined on the rod which selectively receives the balls. In the open relationship of FIG. 1 the balls 38 are in alignment with, and received within, the groove 62 and the valve element 50 is held in the raised position.

Retaining of the detent balls 38 within the rod groove 62 is controlled by the annular piston 64 of an annular expansible motor 66 defined on the spider 20. The expansible motor is defined by surfaces of the spider 20, sleeve 26, and ring 34, as will be appreciated in FIG. 1. The lower side of the chamber 68 located below piston 64 is defined by an annular disc 70 threadedly mounted upon the detent ring 34. The disc 70 is located upon the ring 34 so that an annular orifice 72 exists between the upper edge and periphery of the disc and the annular lower edge of the spider 20. It will be appreciated that the radial dimension of the spider is slightly greater than the radial dimension of the disc producing an "overhang" and this relationship of structure produces an aspirator at the orifice 72 during fluid flow through the valve body so that a subatmospheric pressure tends to be created within the chamber 68.

The expansible motor piston 64 includes a pressure face portion 74 and an inner axially extending detent retaining portion having an outer cam surface 76 which aligns with the detent balls 38 when the piston is in its uppermost position as shown in FIG. 1. Thus, in the uppermost position of FIG. 1, the cam surface 76 maintains the balls 38 within the rod detent groove 62. The piston includes an upper abutment stop 78, and a compression spring 80 interposed between the piston and the disc 70 tends to bias the piston upwardly during resetting, and also insures against inadvertent downward movement of the piston due to axial impacts being imposed upon the valve body or fill tube such as during lowering of the apparatus into the tank.

The chamber 68 is vented to the atmosphere by passage 82 defined in a web 22. The passage 82 intersects the exterior surface of the valve body 10 and is threaded at 84 for receiving a sensing fitting conduit, if the same is used therewith, as will be later described.

The sleeve 26 is axially recessed defining a dashpot chamber 86 when the rod 40 and valve element hub 56 are in the upper or open position. Thus, the radial position of the hub portion in alignment with the chamber 86 functions as a piston and is sealed with respect to the sleeve by an O-ring. The chamber 86 communicates with the valve body fluid passage by an upper bleed passage 90 and a lower bleed passage 92. The bleed passages permit the chamber 86 to fill with liquid during the tank-filling operation and an adjustable restriction fitting 94 mounted within the passage 92 regulates the rate of valve closing, as will be later described.

Resetting of the valve element 50 from the closed to the open position is accomplished through a resetting lever 44 connected to the lower end of the rod 40 by the pin 42. The lever 44 is affixed to a shaft 96 rotatably mounted the valve body 10. The shaft 96 may be exteriorly oscillated by means of a key, such as an allen wrench, or the like, received within the exteriorly accessible socket 98 defined within the end of the shaft.

Operation of the emergency shutoff valve in accord with the invention is as follows: A supply hose or conduit is securely fixed to the threads 16 and the liquid flowing through the valve body 10 is introduced into the tank to be filled through the fill pipe 12 attached to the lower end of the body 10 by threads 18. The valve body and fill pipe are lowered into the tank to be filled and, in the absence of universally adjustable sensing means, as later described, the valve body is lowered into the tank to an extent so that the sensing passage 82 will be vertically located at the maximum liquid level permissible within the tank. The positioning of the valve in this manner may be maintained by pot engaging arms mounted on the valve housing, or the length of the fill pipe may be predetermined so that its engagement with the bottom of the tank properly locates the vent passage. Thus, it will be appreciated that the valve body 10 is located within the uppermost regions of the tank and the vertical position of the sensing conduit represents the highest permissible level of the confined liquid.

The valve element will be in its uppermost or open position, as illustrated in FIG. 1, and maintained in this position by the detent balls 38 which are, in turn, retained in the groove 62 by the piston cam surface 76. Liquid entering the valve body flows between the valve element webs 58, around the spider 20 and into the fill pipe 12 with little restriction and minimum frictional losses. During such flow the passages 90 and 92 permit liquid to flow into the chamber 86, and the liquid flow past the annular orifice 72 tends to produce a subatmospheric pressure on the underside of the piston 64 within the chamber 68. However, due to the venting of the chamber 68 through passage 82 the pressure within the chamber remains substantially atmospheric and no displacement of the piston 64 is produced.

If, due to inadvertence, such as a miscalculation as to the amount of liquid capable of being received within the tank being filled, the liquid level should rise to the sensing vent passage 82, the passage 82 becomes submerged within the liquid and no longer communicates with the atmosephere. The increased resistance of liquid flowing into the chamber 68 through the passage 82 and the decrease in the volume of venting medium, as compared with the venting of air, quickly causes a subatmospheric pressure to develop within the chamber 68. The extent of this subatmospheric pressure is determined by the diameter of the vent passage 82, the viscosity of the liquid being handled, and the efficiency of the aspirator orifice 72. As the orifice 72 is circular and is exposed to substantially all of the fluid flow through the valve body 10, the aspirator capacity for evacuation of the chamber 68 is relatively great, and once the vent passage 82 is submerged in liquid, a significant reduction of pressure occurs within the chamber 68 below the piston 64, as compared with the pressure acting on the upper surface of the piston portion 74. Such pressure differential pushes the piston 64 downwardly, removing the cam surface 76 from the detent balls 38, permitting the balls to move radially outwardly against the relieved piston surface 102, FIG. 2, and releasing the balls from the rod detent groove 62. As the rod 40 is now no longer axially restrained, the downward forces imposed on the valve element 50, and hub 56, due to the flow of liquid, and also gravitational forces, moves the hub and valve element downwardly toward the seal ring 32. Such lowering of the valve element is damped by the dashpot chamber 86 as the lower edge of the hub 56 in alignment with the chamber 86 soon covers the upper passage 90, and the lowering of the valve element is governed by the rate that fluid can escape from the dashpot chamber through the restriction 94. The restriction 94 is of such dimension as to permit the valve element 50 to move toward the seal ring 32 at a rate slow enough to prevent damage to the pumping equipment and produce any "water hammer" effects. Once the bevel surface 60 engages the seal ring 32, liquid flow through the valve body is completely terminated and the tank filling ceases prior to overflowing occurring.

As it is desirable that personnel of the distribution depot inspect the filling location and apparatus in the event of operation of the emergency shutoff valve, the driver must contact depot personnel having access to a key for operating the resetting lever 44 before the valve and filling apparatus can be restored to operation. The insertion of a key into the socket 98 permits the shaft 96 and lever 44 to be rotated to raise the rod 40 to the position of FIG. 1, aligning the rod groove 62 with the balls 38. As there is no fluid flow occurring at this time the pressure within the expansible motor on each side of the piston 64 is equalized and the spring 80 will raise the piston to the position of FIG. 1 which retains the detent balls in the groove. The apparatus is now restored for its next filling operation.

As a single valve and fill pipe are usually used in a gasoline distribution depot to fill many sizes of vehicle mounted tanks, the vent passage 82 will not always be located at the most efficient vertical position to prevent overfill, yet permit the tank to be fully filled, when the fill pipe rests upon the tank bottom. Thus, it is necessary to provide means for positioning the intake of the vent passage at that vertical position most desirable for each tank. The simplest construction would be to attach a hose to the vent passage 82 by threads 84 and locate the end of the hose slightly below the tank pot rim. Thus, if the liquid approached overfill the end of the hose would be submerged and the valve would be tripped closed, as described above. However, such safety features can be easily circumvented by the filling operator not locating the hose as desired and in most cases the operator would probably not bother to locate the sensing hose properly rendering the automatic shutoff valve inoperative for its intended purpose.

Figure 6:
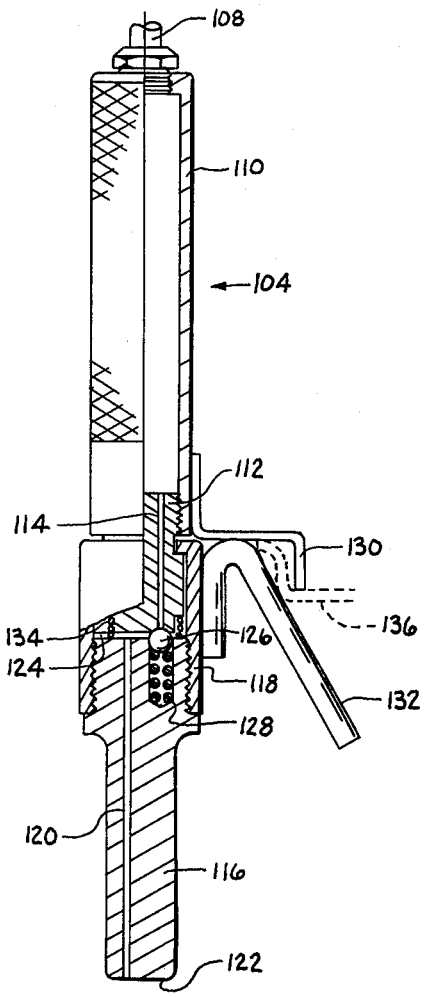
FIG. 6 is a partially sectional view of an embodiment of sensing device illustrated in the closed condition.

In FIG. 6 a sensing device 104 is illustrated which requires that the vent-sensing passage 82 communicate with the tank at a proper level which will prevent overfill, and such a device renders bypassing of the safety features of the valve difficult.

The sensing device 104 is attached to the vent passage 82 by a fitting 106 threadedly connected to threads 84. A flexible hose 108 establishes communication between the vent passage and the sensing device. The sensing device includes two relatively movable members having passages defined therein. The members include a valve arrangement which permits passage through the members at a predetermined orientation of the members, but prevents such passage if the members are not properly oriented. Proper orientation of the sensing device members is achieved by placing the sensing device on the tanker pot rim, thus, insuring proper location of the sensor.

The illustrated sensing device includes an elongated, hollow handle 110 which may be externally knurled to facilitate handling, having an end portion 112 in which the passage 114 is defined. The hose 108 communicates with the other end of the handle and the passage 114. A nose member 116 is rotatably attached to the handle end portion 112 in coaxial alignment therewith by means of a hook-type coupling 118, and member 116 includes a passage 120 communicating with the lower end 122 thereof. The other end of the passage 120 communicates with a chamber 124 defined between the end of the handle portion 112 and the upper end of the hose member 16. A ball check valve 126 within the member 116 is biased by a spring 128 to seal the passage 114 with respect to the chamber 124 at the rotational position of the members 110 and 116 wherein the hook 130 attached to the handle 110 is located substantially above the abutment 132, attached to member 116. As will be appreciated from the drawing, the passages 114 and 120 are eccentrically related to the longitudinal axis of the members 110 and 116, respectively, and stop means, not shown, will position the handle 110 and member 116 so the ball 126 seals the passage 114 with respect to the chamber 124 unless the sensing device is located in operating condition. A torsion spring 134 mounted upon the handle 110 and having an end anchored in member 116 places a torsional force on the members tending to rotate the members to the illustrated position against the stop and, thus, the normal condition of the sensor is as illustrated which prevents venting through the sensor passages and if the operator attempted to fill his tank with the sensor not in the proper position, venting of the chamber 68 cannot occur and the valve element 50 would close almost immediately after liquid flow therethrough began.

In order to permit operation of the filling apparatus, the driver rotates the handle 110 relative to the nose member 116 misaligning the ball check valve 126 from the passage 114. Such rotation also displaces the hook 130 from above the abutment 132 and the hook may be placed over the edge of the tanker upper opening or pot 136. Release of the member 116 permits the spring 134 to pivot the member 116, and abutment 132 toward the stop, but the abutment will engage the underside of the tanker pot prior to the stop being engaged, and prior to the check valve 126 seating on and sealing the passage 114. Thus, simultaneously, the sensing device will be attached to the tanker pot and the maximum fill level of the tank is determined by the vertical position of the nose member lower end 122, which will be several inches below the pot, as determined by the length of the nose member. During filling of the tank the chamber 68 will be vented through the vent passage 82, hose 108 and passages 114 and 120. Should the liquid level reach the end 122, the restriction due to the liquid flowing through the sensing device 104, hose 108 and vent passage 82, will cause the valve element 50 to trip and close.

When filling gasoline in tanks, it is desirable to initially introduce the gasoline into an empty tank at a relatively slow rate to minimize agitation and gasoline vaporization, and minimize the generation of explosive fumes. Additionally, slow fill rates do not generate static electricity and the attendant arcing dangers. Once several inches of gasoline have been introduced into the tank the fill pipe is adequately grounded to the tank as it is submerged within the liquid and the danger of arcing is removed. Additionally, after several inches of gasoline are received within the tank agitation and vaporization is minimized, and it is desirable that the time required for filling the tank be reduced by increasing the rate of flow of the gasoline. To this end, manually operated, slow-fast valves have been used with gasoline filling systems, and FIG. 5 illustrates an automatic slow-fast valve arrangement which may be used in combination with the previously described shutoff valve to produce a filling apparatus particularly suitable for use with gasoline tank filling apparatus.

Figure 5:
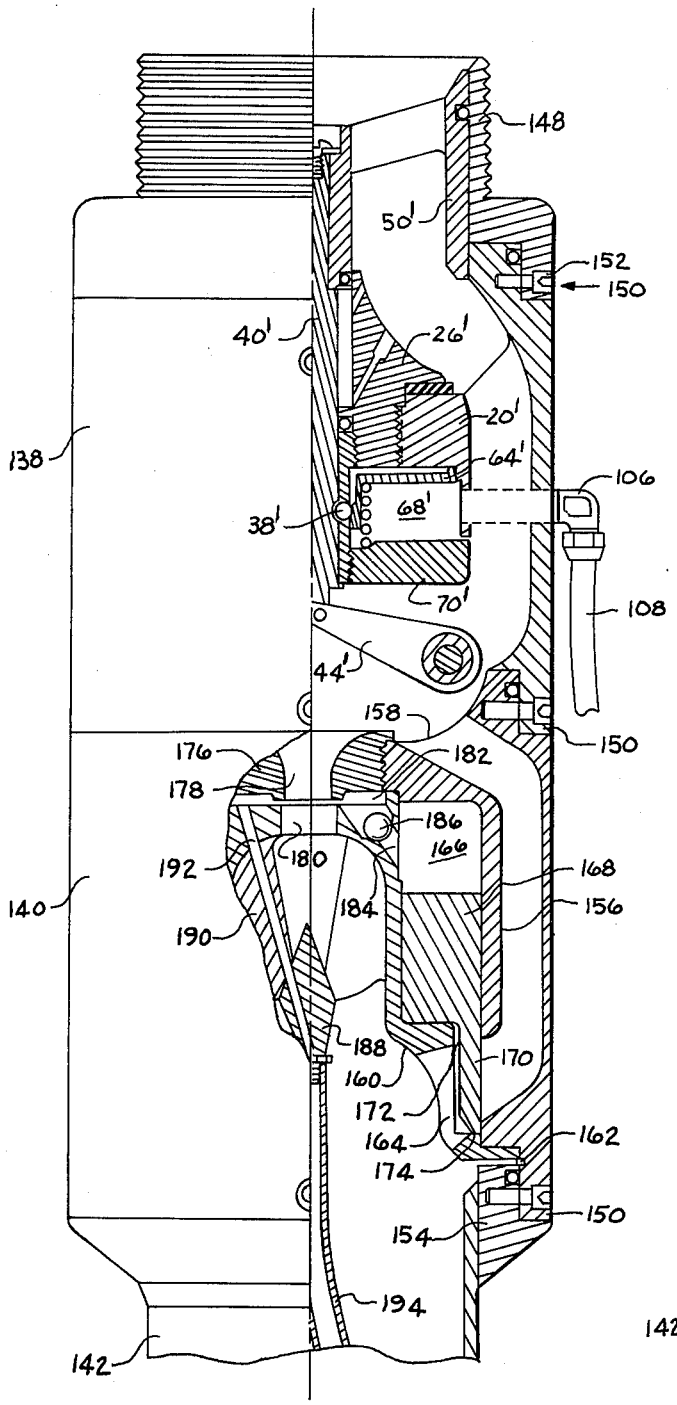
FIG. 5 is an elevational, partially sectional view of the upper portion of an emergency shutoff valve and fast-slow valve mounted on the upper end of a fill pipe.

In FIG. 5 an emergency shutoff valve housing 138 is mounted upon a slow-fast valve housing 140 which is, in turn, mounted upon the upper end of the fill pipe 142. The lower end of the fill pipe is provided with a deflector 14 having outlet openings 146 and deflecting surfaces for smoothly ejecting the fluid through the openings with a minimum of turbulence.

The valve housings 138 and 140 may be of a cast construction, and the valve housing 138 differs from valve body 10, previously described, in that a threaded portion 148 is attached to the valve body by a shouldered connection 150, including an O-ring seal, and threaded cap screws 152 for bolting the threaded portion to the valve body portion. Identical shouldered interconnections are employed between the valve body 138 and the valve body 140, and between the valve body 140 and the ring 154 welded to the upper end of the fill pipe 142. Thus, by using a common type of interconnection between the threaded member 148 and the valve bodies and fill pipe, the emergency shutoff valve 138 alone may be attached to the fill pipe, the slow-fast valve alone may be attached to the fill pipe wherein the threaded portion 148 is directly attached to the valve portion 140, or, as in the illustrated preferred embodiment, the emergency shutoff valve and slow-fast valve may be connected in series with the fill pipe.

The construction and operation of the shutoff valve 138 is identical to the previously described embodiment and like components are indicated by primes. The operation of the shutoff valve is identical with that previously described and further description is unnecessary.

Valve body 140 includes a central chamber having a spider 156 located therein. The spider is mounted within the valve body on four webs 158 and an annular primary passage is defined between the spider and the valve body outer wall through which fluid may flow relatively unrestricted.

The spider 56 includes an annular inner member 160 mounted thereto and maintained in position by a snap ring 162. The inner member 160 includes ports 164 in alignment with the passages defined between the webs of the spider, and the configuration of the spider 156 and the member 160 is such as to define an annular chamber 166 within the spider. An annular piston 168 is slidably received within the chamber 166 and includes an annular axially extending valve element 170 adapted to project through the annular opening 172 defined between the spider and inner member. In its lowermost condition the valve element 170 seats upon the valve seat 174 preventing the flow of fluid around the exterior of the spider through the web passages.

An aspirator orifice member 176 is centrally threadedly mounted upon the spider 156 having an orifice 178 in alignment with orifice 180 defined in the inner member 160. The inner member 160 includes a recessed aspirator chamber 182 communicating with four passages 184 each containing a ball check valve 186. The four passages 184 are spaced about the inner member orifice 180 at 90° intervals but, for purposes of illustration, only one check ball and passage is shown. The passages 184 communicate with the annular chamber 166 and the chamber 182 defined between the inner member and the orifice member 176. The orifice 178 is of a slightly lesser diameter than the inner member portion orifice 180 so that the flow of fluid therethrough produces a reduced pressure within the chamber 182 as the liquid rapidly flows through the orifices 178 and 180.

The inner member 160 includes a spider 188 disposed below the orifice 180 maintained in a position by webs 190. A vent passage 192 extends through the spider 188 through a web and communicates with the chamber 182, as illustrated. The spider includes a hose fitting which receives a hose 194 communicating with the passage 192, and the hose line communicates with a fitting and sensing port 196 located in the lower end of the fill pipe 142 approximately six inches from the bottom of the deflector 14. The sensing fitting 196 includes a check valve chamber having a floating ball check valve 198 seatable with the seat 200 which closes off the passage through the hose 194 when the ball check floats against its seat. The fitting 196 communicates with the exterior of the fill pipe through its port and, during the initial stages of tank filling, the ball check valve 198 will be in the lower full line position illustrated as the liquid within the tank will be below the fitting 196.

Operation of the apparatus of FIG. 5 will now be described:

A supply conduit, usually for gasoline, is threadedly connected to the threaded portion 148 for supplying gasoline to the apparatus. As the apparatus is capable of handling relatively high flow rate capacities, a four inch hose, for instance, is employed as the supply conduit. First, the fill pipe 142 is inserted into the tank pot until the deflector 14 engages the bottom of the tank. The length of the fill pipe may or may not be great enough so the valve housings 138 and 140 will be located above the pot and the function of the apparatus would not be affected if the valves were located below the pot and within the tank.

After the deflector 14 engages the bottom of the tank, the sensing device 104 is placed upon the pot rim in the manner desscribed above. Thus, the sensing passage end 122 will be located below the pot rim for emergency shutoff purposes in the event of overfill.

When the apparatus is introduced into the tank to be filled, the valve element 50' will be in its upper or open position and the piston 168 will be in its lower position illustrated engaging the valve element 170 with the seat 174. Gasoline is now introduced into the valve body 138 and begins flowing therethrough. Such flow tends to reduce the pressure within the chamber 68' but the venting of the chamber through the sensing device 104 prevents operation of the valve element.

As the valve element 170 is in its lower position fluid flow through the valve 140 can only occur through the aspirator orifice 176, and orifice 180 and the size of the orifice 176 is such that approximately 100 gallons per minute will flow through the slow-fast valve and, thus, the valve is in its "slow" flow condition.

Flow through the orifice 178 reduces the pressure within the chamber 182 but as the chamber is vented to the atmosphere through passage 192, hose 194 and sensing fitting 196, no reduction of pressure occurs in the chamber 166 above the piston 168 and the liquid flows through the valve 140 into the fill pipe 142 and is discharged at a relatively slow rate into the tank by the deflector 14. Such slow rate of discharge minimizes turbulence and vaporization of the gasoline entering the tank and does not create electrostatic charges sufficient to produce arcing.

As the tank fills the level of liquid will reach and cover the sensing fitting and port 196 when the level is approximately six inches deep. Upon the liquid entering the sensing fitting the floating ball valve 198 will seat closing the hose 194 and passage 192 to further air flow and subatmospheric pressure quickly occurs within the chamber 182. The presence of the substmospheric pressure within the chamber 182 produces a similar pressure drop in the passage 184 unseating the balls 186 and reducing the pressure within the annular chamber 166 above the piston 168. This decrease of pressure above the piston lifts the piston, removing the valve element 170 from the seat 174 permitting fluid to flow through the web passages about the spider 156. Upon raising of the valve element 170 the fluid flow through the valves and fill pipe 142 is now approximately 800 gallons per minute and such rate of flow would tend to create static electricity as it flows through the filling apparatus. However, as the end of the fill pipe is now well submerged and grounded within the gasoline, the danger of arcing is removed and the desired amount of gasoline may be introduced into the tank as determined by the stop meter.

pressures will be appreciated that after the piston valve element 170 is raised liquid continues to flow through the orifices 178 and 180 producing the substmospheric pressure which maintain the piston 168 in the raised condition.

After the fluid flow has been stopped, the operator rotates the handle 110 and nose member 116 of the sensing device 104 to remove the sensing device from the tank pot and lifts the fill pipe, and attached valves, from the tank. During the removal of the apparatus from the tank the gasoline will drain from the fill pipe and through the valves and, at this time, during draining, the check valves 186 seat to prevent air or liquid from being directly drawn into the chamber 166 above the piston 168. This operation of the check valves slows the decaying of the vacuum within the chamber 166 and permits the gasoline to quickly drain through the valve 140 and fill pipe 142. The chamber 166 will slowly fill with air as the piston lowers due to leakage between the piston and its chamber and the check valves 186 permit the apparatus to drain faster than if draining had to occur solely through the orifice.

As the fill pipe 142 is raised from the liquid the floating ball check 198 drops from its seat 200 draining the associated hose and passages, and the entire apparatus quickly drains so it may be removed from the tank and the apparatus is ready for the next filling operation.

If, during filling, the liquid level reached the sensing device 104, shutoff valve 138 would automatically actuate, as described above, and filling would immediately terminate. The shutoff valve would then have to be manually reset before the apparatus could be reused.

By mounting the emergency shutoff valve and slow-fast valve in series and as these valves operate automatically, a safe, reliable and relatively foolproof apparatus for filling tanks, particularly with a volatile liquid, is provided. Those occurrences most likely to create hazards, such as excessive vaporization, static electricity and overfill are prevented by the described apparatus and a degree of safety and versatility, not herein available in the liquid filling art, is achieved.

Various modifications to the inventive concept may be apparent to those skilled in the art without departing from the spirit and scope of the invention.

I claim:

1. A tank filling system particularly suitable for filling tanks having an upper access opening comprising, in combination, a shutoff valve housing having an axis, an inlet port and an outlet port, liquid supply attachment means defined at said inlet port, an axially extending fluid passage defined in said housing communicating with said ports, an axially movable rod within said valve housing and passage and coaxial therewith, a valve element within said passage mounted on said rod and selectively movable with said rod between open and closed positions, an expansible motor having a movable piston within said valve housing, said expansible motor and piston being of an annular configuration concentrically disposed about said rod, a plurality of detents evenly spaced about said rod engageable with a circumferential groove defined therein, said detents being located intermediate said rod and said annular piston and selectively locking said rod and valve element in said open position, said piston operatively controlling said detents, aspirator means within said passage communicating with said motor tending to produce a vacuum within said motor during liquid flow through said passage, an atmospheric vent communicating with said motor permitting air to enter said motor and prevent movement of said piston while said vent is exposed to the atmosphere, upon said vent being submerged in liquid the substmospheric pressure within said chamber causing displacement of said piston releasing said detents from said rod causing said rod and element to move to said closed position, and manual reset means mounted on said valve housing movably shifting said rod and valve element from said closed position to said open position.

2. In a tank filling system as in claim 1, wherein said detents comprise balls supported in said valve housing for radial displacement with respect to said groove, and cam means defined on said piston engaging said ball detents and determining the radial position thereof.

3. In a tank filling system as in claim 1 wherein said valve element is mounted on the end of said rod extending toward said inlet port and is located adjacent said inlet port, said valve element moving axially in the direction of liquid flow when moving from said open to said closed positions whereby the liquid flow aids in closing said valve element.

4. In a tank filling system as in claim 1 wherein said expansible motor and piston are of an annular configuration concentric with said housing axis, said motor including an annular disc head and said aspirator means including an annular orifice defined adjacent said disc head.

5. In a tank filling system as in claim 1, a flexible conduit having an end communicating with said vent and an end connected to tank liquid level sensing means, said sensing means having tank upper access opening mounting means defined therein.

6. In a tank filling system as in claim 5 wherein said sensing means includes a vent passage, a control valve selectively opening and closing said vent passage, said tank access mounting means controlling operation of said control valve, and including spring biased interlock means closing said control valve and vent passage unless said sensing means is mounted upon the tank access.

7. A tank filling system particularly suitable for filling tanks having an upper access opening comprising, in combination, a fill conduit having an upper end and adapted to be placed in the tank to be filled, a shutoff valve housing having an axis, an inlet end and an outlet end, liquid supply attachment means defined at said inlet end, a fluid passage defined through said valve housing communicating with said ends, a valve element movably mounted within said valve housing and said passage between open and closed positions, respectively, permitting and preventing fluid flow through said passage, said valve housing outlet end being mounted on said fill conduit upper end in communication therewith, valve element operating means within said valve housing holding said valve element in said open position and selectively permitting shifting of said valve element from said open position to said closed position, liquid level sensing means connected to and controlling said operating means, and including a vent passage and a control valve selectively opening and closing said vent passage, a flexible conduit connecting said sensing means to said operating means whereby said sensing means may be positioned adjacent the tank upper access opening, tank access mounting means defined on said sensing means for mounting said sensing means adjacent the tank access opening controlling operation of said control valve and including spring biased interlock means closing said control valve and vent passage unless said sensing means is mounted upon the tank access opening, and valve element reset means mounted on said valve housing connected to said valve element for shifting said valve element from closed position to said open position.

* * * * *